US010684039B2

(12) United States Patent
Li

(10) Patent No.: US 10,684,039 B2
(45) Date of Patent: Jun. 16, 2020

(54) AIR CONDITIONING AND MODE SWITCHING CONTROL METHOD THEREOF

(71) Applicants: GD MIDEA HEATING & VENTILATING EQUIPMENT CO., LTD., Foshan (CN); MIDEA GROUP CO., LTD., Foshan (CN)

(72) Inventor: Yuanyang Li, Foshan (CN)

(73) Assignees: GD MIDEA HEATING & VENTILATING EQUIPMENT CO., LTD., Foshan (CN); MIDEA GROUP CO., LTD, Foshan (CN)

( * ) Notice: Subject to any disclaimer, the term of this patent is extended or adjusted under 35 U.S.C. 154(b) by 7 days.

(21) Appl. No.: 16/169,820

(22) Filed: Oct. 24, 2018

(65) Prior Publication Data

US 2019/0056140 A1 Feb. 21, 2019

Related U.S. Application Data

(63) Continuation of application No. PCT/CN2017/083655, filed on May 9, 2017.

(30) Foreign Application Priority Data

May 31, 2016 (CN) ..... 2016 1 0380274

(51) Int. Cl.
*F24F 11/67* (2018.01)
*F24F 1/00* (2019.01)
(Continued)

(52) U.S. Cl.
CPC ..... *F24F 11/67* (2018.01); *F24F 1/06* (2013.01); *F25B 13/00* (2013.01); *F25B 31/004* (2013.01);
(Continued)

(58) Field of Classification Search
CPC ..... F24F 11/67; F24F 11/86; F24F 1/0003; F24F 1/06; F24F 1/32; F24F 2110/10;
(Continued)

(56) References Cited

U.S. PATENT DOCUMENTS 4,148,436 A * 4/1979 Shaw ..... F25B 1/047 237/2 B
4,245,476 A * 1/1981 Shaw ..... F24D 11/0221 62/235.1
(Continued)

FOREIGN PATENT DOCUMENTS

CN 1477355 A 2/2004
CN 102032648 A 4/2011
(Continued)

OTHER PUBLICATIONS

Yang Yuantao, Multi-split system and control method thereof, Mar. 5, 2015, European Patent Office, pp. 1-13 (Year: 2015).*
(Continued)

*Primary Examiner* — Abdelmoniem I Elamin
(74) *Attorney, Agent, or Firm* — Morgan, Lewis & Bockius LLP

(57) ABSTRACT

Provided are an air conditioner and a mode switching control method thereof. The air conditioner comprises an outdoor unit and an indoor unit. One end of the outdoor unit is connected to one end of the indoor unit via a throttling element, and the other end of the indoor unit is connected to the other end of the outdoor unit via a liquid storage tank. The mode switching control method comprises the following steps: when the indoor unit switches to a refrigeration mode, acquiring an outlet superheat degree of the liquid storage tank, and determining whether the outlet superheat degree is less than a first preset value; and if the outlet superheat degree is less than the first preset value, controlling to turn down the throttling element until the outlet
(Continued)

superheat degree is greater than a second preset value that is greater than the first preset value.

12 Claims, 2 Drawing Sheets

(51) Int. Cl.

| | |
|---|---|
| ***F24F 1/10*** | (2011.01) |
| ***F24F 1/32*** | (2011.01) |
| ***F25B 43/00*** | (2006.01) |
| ***F24F 1/06*** | (2011.01) |
| ***F25B 31/00*** | (2006.01) |
| ***F25B 13/00*** | (2006.01) |
| *F24F 11/86* | (2018.01) |
| *F24F 110/10* | (2018.01) |
| *F24F 1/0003* | (2019.01) |

(52) U.S. Cl.
CPC ..... *F25B 43/006* (2013.01); *F24F 1/0003* (2013.01); *F24F 1/10* (2013.01); *F24F 1/32* (2013.01); *F24F 11/86* (2018.01); *F24F 2110/10* (2018.01); *F25B 2600/21* (2013.01); *F25B 2700/1933* (2013.01); *F25B 2700/2113* (2013.01); *F25B 2700/21151* (2013.01)

(58) Field of Classification Search
CPC ..... F25B 13/00; F25B 2600/21; F25B 2700/1933; F25B 2700/2113; F25B 2700/21151; F25B 31/004; F25B 43/006
See application file for complete search history.

(56) References Cited

U.S. PATENT DOCUMENTS

| | | | | |
|---|---|---|---|---|
| 10,101,054 | B2 * | 10/2018 | Huang | F24F 13/30 |
| 2018/0100668 | A1 * | 4/2018 | Huang | F24F 13/30 |

FOREIGN PATENT DOCUMENTS

| | | | |
|---|---|---|---|
| CN | 202927982 | U | 5/2013 |
| CN | 103486700 | A | 1/2014 |
| CN | 104676845 | A | 6/2015 |
| CN | 105066539 | A | 11/2015 |
| CN | 106016458 | A | 10/2016 |
| EP | 2787305 | A1 | 10/2014 |
| JP | 2002054836 | A | 2/2002 |
| JP | 4538919 | B2 | 9/2010 |

OTHER PUBLICATIONS

GD Midea Heating & Ventilating Equipment Co Ltd, et al., International Search Report, PCT/CN2017/083655, dated Aug. 17, 2017, 15 pgs.

Guangdong Midea HVAC Equipment Co Ltd., Office Action, CN201610380274.7, dated Apr. 7, 2018, 9 pgs.

GD Midea Heating & Ventilating Equipment Co Ltd, et al., Extended European Search Report, EP17805624.8, dated Apr. 4, 2019, 7 pgs.

* cited by examiner

AIR CONDITIONING AND MODE SWITCHING CONTROL METHOD THEREOF

CROSS-REFERENCE TO RELATED APPLICATIONS

This application is a continuation application of PCT/CN2017/083655, entitled "AIR CONDITIONER AND MODE SWITCHING CONTROL METHOD THEREOF" filed on May 9, 2017, which claims priority to Chinese Patent Application No. 201610380274.7, entitled "AIR CONDITIONER AND MODE SWITCHING CONTROL METHOD THEREOF" filed with the State Intellectual Property Office of P. R. China on May 31, 2016, all of which are incorporated herein by reference.

TECHNICAL FIELD

The present disclosure relates to an air conditioner technology field, and more particularly to an air conditioner and a mode switching control method thereof.

BACKGROUND

In an air-conditioning system, functions of a heat exchanger of outdoor unit and indoor unit in a heating mode and in a refrigerating mode are just opposite with each other. When the air-conditioning system is operating in the heating mode, a low-pressure side of the outdoor unit is used as an evaporator, and the high-pressure side of the indoor unit is used as a condenser. When the air-conditioning system is operating in the refrigerating mode, the high-pressure side of the outdoor unit is used as the condenser, and the low-pressure side of the indoor unit is used as the evaporator.

In the refrigerating mode, refrigerant is condensed in the outdoor condenser, while, in the heating mode, the refrigerant is condensed in the indoor condenser. A size of the condenser determines a capacity of liquid refrigerant that the system can carry. In the heating mode, refrigerant capacity required by the system is little, and in the refrigerating mode, the refrigerant capacity required by the system is large. In one system, only a fixed capacity of refrigerant can generally be filled, therefore, in the heating mode, refrigerant not required is stored by configuring a liquid storage tank. In addition, when the air-conditioning system is cooling off, the high pressure of the outdoor unit is high, and the pressure of the liquid storage tank is relatively low, thus refrigerant of the system may be automatically transferred from the outdoor condenser to the liquid storage tank. In addition, when the air-conditioning system is in a refrigerating and oil returning mode, a frequency of a compressor of the outdoor unit is high, and opening of the throttling element of the indoor unit is large, thus the refrigerant will carry oil back to the outdoor unit at a high speed, and a large amount of refrigerant will also return to the liquid storage tank.

Therefore, when the system is switched from the heating mode to the refrigerating mode, the system refrigerating mode is started, and the system is switched from the refrigerating and oil returning mode to the refrigerating mode, a large amount of refrigerant may exist in the liquid storage tank, which easily causes low pressure to be high and refrigerant capacity of indoor unit to be less, which further leads to poorer refrigerating capacity of indoor unit.

SUMMARY

Embodiments of the present disclosure seek to solve at least one of the problems existing in the related art to at least some extent.

Accordingly, an objective of the present disclosure is to provide a mode switching control method of an air conditioner. With this method, when an indoor unit is switched to a refrigerating mode, throttling effect is improved by turning down the opening of the throttling element, such that a lower pressure is obtained, and temperature difference in heat exchange and refrigerant capacity in heat exchange are improved, thus the indoor unit has a better refrigerating capacity.

Another objective of the present disclosure is to provide a non-transitory computer-readable storage medium.

Another objective of the present disclosure is to provide an air conditioner.

To achieve the above objectives, embodiments of one aspect of the present disclosure provide a mode switching control method of an air conditioner. The air conditioner includes an outdoor unit and an indoor unit. The outdoor unit includes a compressor. A first end of the outdoor unit is connected to a first end of the indoor unit via a throttling element, and a second end of the indoor unit is connected to a second end of the outdoor unit via a liquid storage tank. The method includes: in response to switching the indoor unit to a refrigerating mode, obtaining an outlet superheat degree of the liquid storage tank, and determining whether the outlet superheat degree is less than a first preset threshold; and in accordance with a determination that the outlet superheat degree is less than the first preset threshold, reducing opening of the throttling element until the outlet superheat degree is greater than a second preset threshold, in which the second preset threshold is greater than the first preset threshold.

With the mode switching control method of an air conditioner according to embodiments of the present disclosure, when the indoor unit is switched to the refrigerating mode, the outlet superheat degree of the liquid storage tank is obtained, and it is determined whether the outlet superheat degree is less than the first preset threshold, in accordance with a determination that the outlet superheat degree is less than the first preset threshold, the opening of the throttling element is turned down until the outlet superheat degree is greater than the second preset threshold, thereby throttling effect is improved by turning down the opening of the throttling element, such that a lower pressure is obtained, and temperature difference in heat exchange and refrigerant capacity in heat exchange are improved, thus the indoor unit has a better refrigerating capacity.

According to an embodiment of the present disclosure, the method further includes: in accordance with a determination that the outlet superheat degree is less than the first preset threshold, adjusting a saturation temperature corresponding to a target suction pressure of the compressor according to the outlet superheat degree, and controlling the compressor according to the adjusted saturation temperature.

According to an embodiment of the present disclosure, the saturation temperature corresponding to the target suction pressure of the compressor is adjusted based on a formula of $$Tesm2=\mathrm{MAX}(Tesm1-(A-SSH)/A*4,B),$$

wherein, Tesm2 is the adjusted saturation temperature, Tesm1 is the saturation temperature corresponding to the target suction pressure of the compressor before adjusting, A is the first preset threshold, SSH is the outlet superheat degree of the liquid storage tank, and B is a saturation temperature corresponding to a minimum target discharge pressure of the compressor.

According to an embodiment of the present disclosure, the outlet superheat degree of the liquid storage tank is obtained based on a formula of $$SSH=Ts-Te,$$

wherein, SSH is the outlet superheat degree of the liquid storage tank, Ts is a suction temperature of the compressor, and Te is a saturation temperature corresponding to a return air pressure of the compressor.

According to an embodiment of the present disclosure, switching the indoor unit to the refrigerating mode includes: starting the indoor unit in the refrigerating mode; switching the indoor unit from a refrigerating and oil returning mode to the refrigerating mode; and switching the indoor unit from a heating mode to the refrigerating mode.

To achieve the above objectives, the present disclosure further provides a non-transitory computer-readable storage medium having stored thereon computer programs that, when executed by a processor, causes the above mode switching control method of an air conditioner to be performed.

With the non-transitory computer-readable storage medium according to embodiments of the present disclosure, by performing above mode switching control method of an air conditioner, when the indoor unit is switched to the refrigerating mode, throttling effect is improved by turning down the opening of the throttling element, such that a lower pressure is obtained, and temperature difference in heat exchange and refrigerant capacity in heat exchange are improved, thus the indoor unit has a better refrigerating capacity.

To achieve the above objectives, embodiments of another aspect of the present disclosure provide an air conditioner, including: an outdoor unit comprising a compressor; an indoor unit, wherein a first end of the outdoor unit is connected to a first end of the indoor unit via a throttling element, and a second end of the indoor unit is connected to a second end of the outdoor unit via a liquid storage tank; and a control module, configured to, in response to switching the indoor unit to a refrigerating mode, obtain an outlet superheat degree of the liquid storage tank, and determine whether the outlet superheat degree is less than a first preset threshold, and in accordance with a determination that the outlet superheat degree is less than the first preset threshold, turn down opening of the throttling element until the outlet superheat degree is greater than a second preset threshold, in which the second preset threshold is greater than the first preset threshold.

With the air conditioner according to embodiments of the present disclosure, when the indoor unit is switched to the refrigerating mode, the control module obtains the outlet superheat degree of the liquid storage tank, and determines whether the outlet superheat degree is less than the first preset threshold, in accordance with a determination that the outlet superheat degree is less than the first preset threshold, the control module turns down the opening of the throttling element until the outlet superheat degree is greater than the second preset threshold, thereby throttling effect is improved by turning down the opening of the throttling element, such that a lower pressure is obtained, and temperature difference in heat exchange and refrigerant capacity in heat exchange are improved, thus the indoor unit has a better refrigerating capacity.

According to an embodiment of the present disclosure, in accordance with a determination that the outlet superheat degree is less than the first preset threshold, the control module is further configured to adjust a saturation temperature corresponding to a target suction pressure of the compressor according to the outlet superheat degree, and to control the compressor according to the adjusted saturation temperature.

According to an embodiment of the present disclosure, the control module is configured to adjust the saturation temperature corresponding to the target suction pressure of the compressor based on a formula of $$Tesm2=\mathrm{MAX}(Tesm1-(A-SSH)/A*4,B),$$

wherein, Tesm2 is the adjusted saturation temperature, Tesm1 is the saturation temperature corresponding to the target suction pressure of the compressor before adjusting, A is the first preset threshold, SSH is the outlet superheat degree of the liquid storage tank, and B is a saturation temperature corresponding to a minimum target discharge pressure of the compressor.

According to an embodiment of the present disclosure, the control module is configured to obtain the outlet superheat degree of the liquid storage tank based on a formula of:

$$SSH=Ts-Te,$$

wherein, SSH is the outlet superheat degree of the liquid storage tank, Ts is a suction temperature of the compressor, and Te is a saturation temperature corresponding to a suction pressure of the compressor.

According to an embodiment of the present disclosure, switching the indoor unit to the refrigerating mode includes: starting the indoor unit in the refrigerating mode; switching the indoor unit from a refrigerating and oil returning mode to the refrigerating mode; and switching the indoor unit from a heating mode to the refrigerating mode.

DETAILED DESCRIPTION

Figure 1:
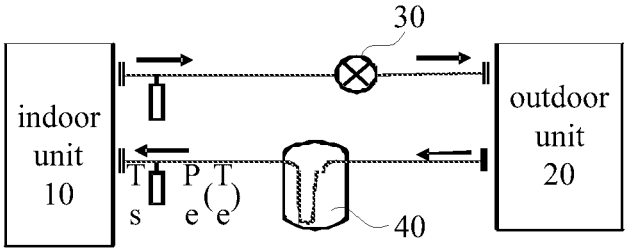
FIG. 1 is a schematic diagram of an air conditioner according to an embodiment of the present disclosure.

Reference will be made in detail to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In embodiments of the present disclosure, as illustrated in FIG. 1, an air conditioner may include an outdoor unit and an indoor unit. The outdoor unit includes a compressor. A first end of the outdoor unit is connected to a first end of the indoor unit via a throttling element, and a second end of the indoor unit is connected to a second end of the outdoor unit via a liquid storage tank.

As illustrated in FIG. 1, when the air conditioner is started in a refrigerating mode, or when the air conditioner is switched from a heating mode to the refrigerating mode, or when the air conditioner is switched from a refrigerating and oil returning mode to the refrigerating mode, a large amount of refrigerant exists in the liquid storage tank, such that a pressure in the liquid storage tank is too high, and an outlet superheat degree of the liquid storage tank decreases. The compressor mainly sucks steam with a low degree of dryness from the liquid storage tank. At this time, if the compressor is adjusted according to a normal saturation temperature corresponding to an initial target suction pressure, an initial frequency of the compressor may be low, suction effect of the compressor may be relative small, refrigerant in the indoor unit is relative little, and superheat degree of the indoor unit is easy to be too large. The opening of the throttling element is generally regarded to be too small when the superheat degree of the indoor unit is large. At this time, the opening of the throttling element may be turned up continuously. As a result, the throttling effect of the indoor unit becomes smaller, and refrigerating capacity of the indoor unit becomes bad mainly because gas-phase heat exchange.

Accordingly, embodiments of the present disclosure provide a mode switching control method of an air conditioner, when the air conditioner is started in a refrigerating mode, or when the air conditioner is switched from a heating mode to the refrigerating mode, or when the air conditioner is switched from a refrigerating and oil returning mode to the refrigerating mode, throttling effect is improved by turning down the opening of the throttling element, such that a lower pressure is obtained, and temperature difference in heat exchange and refrigerant capacity in heat exchange are improved, thus the indoor unit has a better refrigerating capacity.

Figure 2:
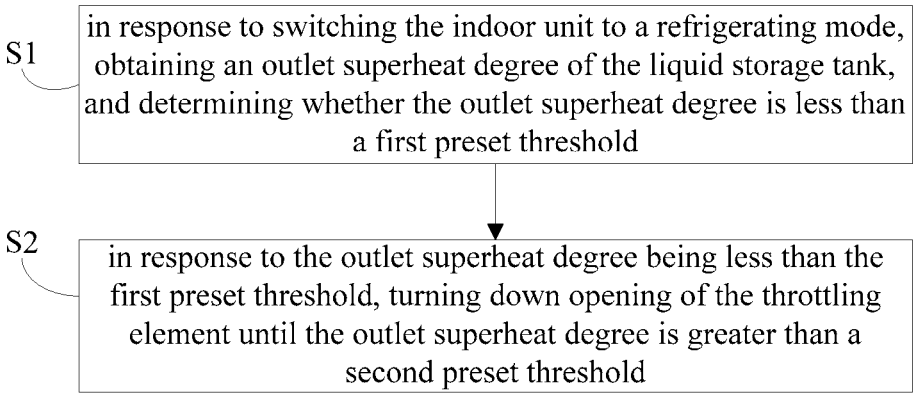
FIG. 2 is a flow chart of a mode switching control method of an air conditioner according to an embodiment of the present disclosure.

FIG. 2 is a flow chart of a mode switching control method of an air conditioner according to an embodiment of the present disclosure. As illustrated in FIG. 2, the mode switching control method of an air conditioner includes following steps.

At block S1, in response to switching the indoor unit to a refrigerating mode, an outlet superheat degree of the liquid storage tank is obtained, and it is determined whether the outlet superheat degree is less than a first preset threshold.

According to an embodiment of the present disclosure, the outlet superheat degree of the liquid storage tank may be obtained based on formula (1).

$$SSH=Ts-Te \quad (1)$$

wherein, SSH is the outlet superheat degree of the liquid storage tank, Ts is a suction temperature of the compressor, and Te is a saturation temperature corresponding to a suction pressure of the compressor.

At block S2, in accordance with a determination that the outlet superheat degree is less than the first preset threshold, opening of the throttling element is turned down until the outlet superheat degree is greater than a second preset threshold. The second preset threshold is greater than the first preset threshold. The first preset threshold and the second preset threshold may be calibrated according to practical situation, the first preset threshold is a smaller value than.

Specifically, when the indoor unit is started in a refrigerating mode, when the indoor unit is switched from a refrigerating and oil returning mode to the refrigerating mode, and when the indoor unit is switched from a heating mode to the refrigerating mode, the outlet superheat degree SSH of the liquid storage tank may decrease. When it is detected that the outlet superheat degree SSH of the liquid storage tank is less than the first preset threshold, in order to improve vacuum effect, low pressure needs to be reduced. In this situation, the low pressure may be reduced by improving throttling effect, i.e., by decreasing the opening of the throttling element of the indoor unit, and both high pressure and the low pressure are in a secure range. When it is detected that the outlet superheat degree SSH of the liquid storage tank is greater than the second preset threshold, adjusting the opening of the throttling element is stopped. Thereby, temperature difference in heat exchange and refrigerant capacity in heat exchange are improved, and refrigerating capacity of the indoor unit is improved.

Further, in an embodiment of the present disclosure, when the outlet superheat degree is less than the first preset threshold, a saturation temperature corresponding to a target suction pressure of the compressor is adjusted according to the outlet superheat degree, and the compressor is controlled according to the adjusted saturation temperature. The saturation temperature corresponding to the target suction pressure of the compressor may be adjusted based on formula (2).

$$Tesm2=\mathrm{MAX}(Tesm1-(A-SSH)/A*4,B) \quad (2)$$

wherein, Tesm2 is the adjusted saturation temperature, Tesm1 is the saturation temperature corresponding to the target suction pressure of the compressor before adjusting, A is the first preset threshold, SSH is the outlet superheat degree of the liquid storage tank, and B is a saturation temperature corresponding to a minimum target discharge pressure of the compressor. The minimum target discharge pressure is a pressure that can ensure a system to securely operate.

Figure 3:
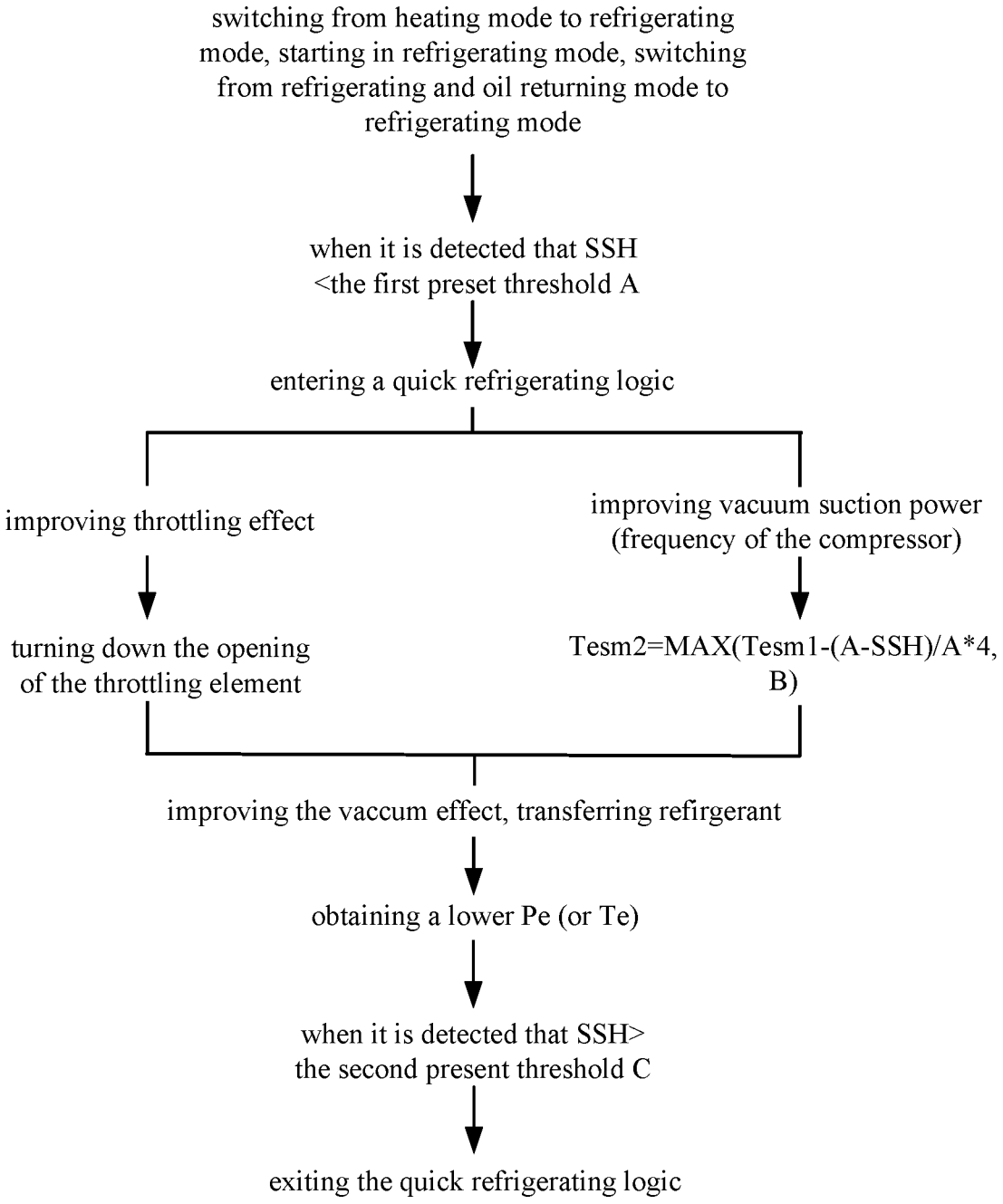
FIG. 3 is a schematic diagram illustrating mode switching control principle of an air conditioner according to an embodiment of the present disclosure.

In detail, as illustrated in FIG. 3, after receiving an instruction for switching to the refrigerating mode, when it is detected that the outlet superheat degree SSH of the liquid storage tank is less than the first preset threshold A, in order to improve vacuum effect, low pressure needs to be reduced. In this situation, following two aspects may be adjusted.

1) Throttling effect is improved, i.e., the opening of the throttling element of indoor unit is turned down;

2) Vacuum suction power is improved by increasing the frequency of the compressor. That is, the current outlet superheat degree SSH of the liquid storage tank and the saturation temperature Tesm1 corresponding to the target suction pressure of the compressor are obtained firstly, and then a new saturation temperature Tesm2 corresponding to the target suction pressure of the compressor is calculated based on above-mentioned formula (2), and the compressor is controlled according to the saturation temperature Tesm2 corresponding to the target suction pressure of the compressor. In this situation, the frequency of the compressor may be increased according to demand, and both the high pressure and the low pressure are in a secure range.

After adjusting the throttling element and the frequency of the compressor, the system may obtain a lower suction pressure Pe (or a saturation temperature Te corresponding to the suction pressure). When it is detected that the outlet superheat degree SSH of the liquid storage tank is greater than the second preset threshold C, adjusting the throttling element and the compressor is stopped. Thereby, the refrigerant in the liquid storage tank is quickly transferred to the indoor unit by improving vacuum effect, thus reducing the low pressure, improving temperature difference in heat exchange and refrigerant capacity in heat exchange, and improving refrigerating capacity of the indoor unit.

In conclusion, with the mode switching control method of an air conditioner according to embodiments of the present disclosure, when the indoor unit is switched to the refrigerating mode, the outlet superheat degree of the liquid storage tank is obtained, and it is determined whether the outlet superheat degree is less than the first preset threshold, in accordance with a determination that the outlet superheat degree is less than the first preset threshold, the opening of the throttling element is turned down until the outlet superheat degree is greater than the second preset threshold, thereby throttling effect is improved by turning down the opening of the throttling element to obtain a lower low pressure. In addition, while adjusting the throttling element, vacuum suction capacity may be improved by increasing the frequency of the compressor, thus effectively improving the vacuum effect, quickly transferring the refrigerant to the indoor unit, reducing the low pressure, improving the temperature difference in heat exchange and the refrigerant capacity in heat exchange, so that the indoor machine can achieve better refrigeration capacity.

In addition, the present disclosure further provides a non-transitory computer-readable storage medium having stored thereon computer programs that, when executed by a processor, causes the above mode switching control method of an air conditioner to be performed.

With the non-transitory computer-readable storage medium according to embodiments of the present disclosure, by performing above mode switching control method of an air conditioner, when the indoor unit is switched to the refrigerating mode, throttling effect is improved by turning down the opening of the throttling element, such that a lower pressure is obtained, and temperature difference in heat exchange and refrigerant capacity in heat exchange are improved, thus the indoor unit has a better refrigerating capacity.

An air conditioner provided by an embodiment of the present disclosure will be described below with reference to FIG. 1. As illustrated in FIG. 1, the air conditioner includes: an outdoor unit 10, an indoor unit 20 and a control module (not shown in FIG. 1).

The outdoor unit 10 includes a compressor. A first end of the outdoor unit 10 is connected to a first end of the indoor unit 20 with a throttling element 30, and a second end of the indoor unit 20 is connected to a second end of the outdoor unit 10 with a liquid storage tank 40. The control module is configured to, in response to switching the indoor unit 20 to a refrigerating mode, obtain an outlet superheat degree of the liquid storage tank 40, and determine whether the outlet superheat degree is less than a first preset threshold, and in accordance with a determination that the outlet superheat degree is less than the first preset threshold, turn down opening of the throttling element 30 until the outlet superheat degree is greater than a second preset threshold, in which the second preset threshold is greater than the first preset threshold.

According to an embodiment of the present disclosure, the outlet superheat degree of the liquid storage tank may be obtained based on the above-mentioned formula (1).

In detail, when the indoor unit 20 is started in a refrigerating mode, when the indoor unit 20 is switched from a refrigerating and oil returning mode to the refrigerating mode, and when the indoor unit 20 is switched from a heating mode to the refrigerating mode, the outlet superheat degree SSH of the liquid storage tank 40 may decrease. When it is detected that the outlet superheat degree SSH of the liquid storage tank 40 is less than the first preset threshold, in order to improve vacuum effect, low pressure needs to be reduced. In this situation, the low pressure may be reduced by improving throttling effect, i.e., by decreasing the opening of the throttling element 30 of the indoor unit, and both high pressure and the low pressure are in a secure range. When it is detected that the outlet superheat degree SSH of the liquid storage tank 40 is greater than the second preset threshold, adjusting the opening of the throttling element 30 is stopped. Thereby, temperature difference in heat exchange and refrigerant capacity in heat exchange are improved, and refrigerating capacity of the indoor unit is improved.

Further, in an embodiment of the present disclosure, in accordance with a determination that the outlet superheat degree is less than the first preset threshold, the control module is further configured to adjust a saturation temperature corresponding to a target suction pressure of the compressor according to the outlet superheat degree, and to control the compressor according to the adjusted saturation temperature. The control module may be configured to adjust the saturation temperature corresponding to the target suction pressure of the compressor based on the above-mentioned formula (2).

In detail, as illustrated in FIG. 3, after the control module receives an instruction for switching to the refrigerating mode, when it is detected that the outlet superheat degree SSH of the liquid storage tank 40 is less than the first preset threshold A, in order to improve vacuum effect, low pressure needs to be reduced. In this situation, following two aspects may be adjusted.

1) Throttling effect is improved, i.e., the opening of the throttling element is turned down;

2) Vacuum suction power is improved by increasing the frequency of the compressor. That is, the current outlet superheat degree SSH of the liquid storage tank 40 and the saturation temperature Tesm1 corresponding to the target suction pressure of the compressor are obtained firstly, and then a new saturation temperature Tesm2 corresponding to the target suction pressure of the compressor is calculated based on above-mentioned formula (2), and the compressor is controlled according to the saturation temperature Tesm2 corresponding to the target suction pressure of the compressor. In this situation, the frequency of the compressor may be increased according to demand, and both the high pressure and the low pressure are in a secure range.

After the control module adjusts the throttling element 30 and the frequency of the compressor, the system may obtain a lower suction pressure Pe (or a saturation temperature Te corresponding to the suction pressure). When it is detected that the outlet superheat degree SSH of the liquid storage tank 40 is greater than the second preset threshold C, adjusting the throttling element 30 and the compressor is stopped. Thereby, the refrigerant in the liquid storage tank is quickly transferred to the indoor unit by improving vacuum effect, thus reducing the low pressure, improving temperature difference in heat exchange and refrigerant capacity in heat exchange, and improving refrigerating capacity of the indoor unit.

With the air conditioner according to embodiments of the present disclosure, when the indoor unit is switched to the refrigerating mode, the control module obtains the outlet superheat degree of the liquid storage tank, and determines whether the outlet superheat degree is less than the first preset threshold, in accordance with a determination that the outlet superheat degree is less than the first preset threshold, the control module turns down the opening of the throttling element until the outlet superheat degree is greater than the second preset threshold, thereby throttling effect is improved by turning down the opening of the throttling element to obtain a lower low pressure. In addition, while adjusting the throttling element, vacuum suction capacity may be improved by increasing the frequency of the compressor, thus effectively improving the vacuum effect, quickly transferring the refrigerant to the indoor unit, reducing the low pressure, improving the temperature difference in heat exchange and the refrigerant capacity in heat exchange, so that the indoor machine can achieve better refrigeration capacity.

In the description of the present disclosure, it should be understood that, terms such as "first" and "second" are used herein for purposes of description and are not intended to indicate or imply relative importance or significance or to imply the number of indicated technical features. Thus, the feature defined with "first" and "second" may comprise one or more this feature. In the description of the present disclosure, "a plurality of" means two or more than two, such as two or three, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the description of the present disclosure, reference throughout this specification to "an embodiment," "some embodiments," "example," "a specific example," or "some examples," means that a particular feature, structure, material, or characteristic described in connection with the embodiment or example is included in at least one embodiment or example of the present disclosure. In the specification, the terms mentioned above are not necessarily referring to the same embodiment or example of the present disclosure. Furthermore, the particular features, structures, materials, or characteristics may be combined in any suitable manner in one or more embodiments or examples. Besides, any different embodiments and examples and any different characteristics of embodiments and examples may be combined by those skilled in the art without contradiction.

In addition, any process or method described herein in the flow chart or in other manners may be understood to represent a module, segment, or portion of code that comprises one or more executable instructions to implement the specified logic function(s) or that comprises one or more executable instructions of the steps of the progress. Although the flow chart shows a specific order of execution, it is understood that the order of execution may differ from that which is depicted. For example, the order of execution of two or more boxes may be scrambled relative to the order shown.

The logic and/or step described in other manners herein or shown in the flow chart, for example, a particular sequence table of executable instructions for realizing the logical function, may be specifically achieved in any computer readable medium to be used by the instruction execution system, device or equipment (such as the system based on computers, the system comprising processors or other systems capable of obtaining the instruction from the instruction execution system, device and equipment and executing the instruction), or to be used in combination with the instruction execution system, device and equipment. As to the specification, "the computer readable medium" may be any device adaptive for including, storing, communicating, propagating or transferring programs to be used by or in combination with the instruction execution system, device or equipment. More specific examples of the computer readable medium comprise but are not limited to: an electronic connection (an electronic device) with one or more wires, a portable computer enclosure (a magnetic device), a random access memory (RAM), a read only memory (ROM), an erasable programmable read-only memory (EPROM or a flash memory), an optical fiber device and a portable compact disk read-only memory (CDROM). In addition, the computer readable medium may even be a paper or other appropriate medium capable of printing programs thereon, this is because, for example, the paper or other appropriate medium may be optically scanned and then edited, decrypted or processed with other appropriate methods when necessary to obtain the programs in an electric manner, and then the programs may be stored in the computer memories.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A mode switching control method of an air conditioner, wherein the air conditioner comprises an outdoor unit and an indoor unit, the outdoor unit has a compressor, a first end of the outdoor unit is connected to a first end of the indoor unit via a throttling element, a second end of the indoor unit is connected to a second end of the outdoor unit via a liquid storage tank, the method comprising:

in response to switching the indoor unit to a refrigerating mode, obtaining an outlet superheat degree of the liquid storage tank, and determining whether the outlet superheat degree is less than a first preset threshold; and in accordance with a determination that the outlet superheat degree is less than the first preset threshold;

reducing opening of the throttling element until the outlet superheat degree is greater than a second preset threshold, wherein the second preset threshold is greater than the first preset threshold; and increasing a vacuum suction capacity of the compressor by increasing a frequency of the compressor, wherein increasing the frequency of the compressor includes controlling the compressor according to an adjusted saturation temperature corresponding to a target suction pressure of the compressor based on the outlet superheat degree.

2. The method according to claim 1, wherein the adjusted saturation temperature corresponding to the target suction pressure of the compressor is determined based on a formula of $$Tesm2=\mathrm{MAX}(Tesm1-(A-SSH)/A*4,B),$$

wherein Tesm2 is the adjusted saturation temperature, Tesm1 is a saturation temperature corresponding to the target suction pressure of the compressor before adjusting, A is the first preset threshold, SSH is the outlet superheat degree of the liquid storage tank, and B is a saturation temperature corresponding to a minimum target discharge pressure of the compressor.

3. The method according to claim 1, wherein the outlet superheat degree of the liquid storage tank is obtained based on a formula of $$SSH=Ts-Te,$$

wherein SSH is the outlet superheat degree of the liquid storage tank, Ts is a suction temperature of the compressor, and Te is a saturation temperature corresponding to a suction pressure of the compressor.

4. The method according to claim 1, wherein switching the indoor unit to the refrigerating mode comprises:

starting the indoor unit in the refrigerating mode;

switching the indoor unit from a refrigerating and oil returning mode to the refrigerating mode; and switching the indoor unit from a heating mode to the refrigerating mode.

5. An air conditioner, comprising:

an outdoor unit having a compressor;

an indoor unit, wherein a first end of the outdoor unit is connected to a first end of the indoor unit via a throttling element, and a second end of the indoor unit is connected to a second end of the outdoor unit via a liquid storage tank; and a control module, configured to, in response to switching the indoor unit to a refrigerating mode, obtain an outlet superheat degree of the liquid storage tank, and determine whether the outlet superheat degree is less than a first preset threshold, and in accordance with a determination that the outlet superheat degree is less than the first preset threshold:

turn down opening of the throttling element until the outlet superheat degree is greater than a second preset threshold, wherein the second preset threshold is greater than the first preset threshold; and increase a vacuum suction capacity of the compressor by increasing a frequency of the compressor, wherein increasing the frequency of the compressor includes controlling the compressor according to an adjusted saturation temperature corresponding to a target suction pressure of the compressor based on the outlet superheat degree.

6. The air conditioner according to claim 5, wherein the control module is configured to determine the adjusted saturation temperature corresponding to the target suction pressure of the compressor based on a formula of $$Tesm2=\mathrm{MAX}(Tesm1-(A-SSH)/A*4,B),$$

wherein Tesm2 is the adjusted saturation temperature, Tesm1 is a saturation temperature corresponding to the target suction pressure of the compressor before adjusting, A is the first preset threshold, SSH is the outlet superheat degree of the liquid storage tank, and B is a saturation temperature corresponding to a minimum target discharge pressure of the compressor.

7. The air conditioner according to claim 5, wherein the control module is configured to obtain the outlet superheat degree of the liquid storage tank based on a formula of $$SSH=Ts-Te,$$

wherein SSH is the outlet superheat degree of the liquid storage tank, Ts is a suction temperature of the compressor, and Te is a saturation temperature corresponding to a suction pressure of the compressor.

8. The air conditioner according to claim 5, wherein switching the indoor unit to the refrigerating mode comprises:

starting the indoor unit in the refrigerating mode;

switching the indoor unit from a refrigerating and oil returning mode to the refrigerating mode; and switching the indoor unit from a heating mode to the refrigerating mode.

9. A non-transitory computer-readable storage medium, having stored thereon computer programs that, when executed by a processor, causes the processor to perform a mode switching control method of an air conditioner having an outdoor unit and an indoor unit, wherein the outdoor unit comprises a compressor, a first end of the outdoor unit is connected to a first end of the indoor unit via a throttling element, a second end of the indoor unit is connected to a second end of the outdoor unit via a liquid storage tank, the method comprising:

in response to switching the indoor unit to a refrigerating mode, obtaining an outlet superheat degree of the liquid storage tank, and determining whether the outlet superheat degree is less than a first preset threshold; and in accordance with a determination that the outlet superheat degree is less than the first preset threshold;

reducing opening of the throttling element until the outlet superheat degree is greater than a second preset threshold, wherein the second preset threshold is greater than the first preset threshold; and increasing a vacuum suction capacity of the compressor by increasing a frequency of the compressor, wherein increasing the frequency of the compressor includes controlling the compressor according to an adjusted saturation temperature corresponding to a target suction pressure of the compressor based on the outlet superheat degree.

10. The non-transitory computer-readable storage medium according to claim 9, wherein the adjusted saturation temperature corresponding to the target suction pressure of the compressor is determined based on a formula of $$Tesm2=\mathrm{MAX}(Tesm1-(A-SSH)/A*4,B),$$

wherein Tesm2 is the adjusted saturation temperature, Tesm1 is a saturation temperature corresponding to the target suction pressure of the compressor before adjusting, A is the first preset threshold, SSH is the outlet superheat degree of the liquid storage tank, and B is a saturation temperature corresponding to a minimum target discharge pressure of the compressor.

11. The non-transitory computer-readable storage medium according to claim 9, wherein the outlet superheat degree of the liquid storage tank is obtained based on a formula of $$SSH=Ts-Te,$$

wherein SSH is the outlet superheat degree of the liquid storage tank, Ts is a suction temperature of the compressor, and Te is a saturation temperature corresponding to a suction pressure of the compressor.

12. The non-transitory computer-readable storage medium according to claim 9, wherein switching the indoor unit to the refrigerating mode comprises:

starting the indoor unit in the refrigerating mode;

switching the indoor unit from a refrigerating and oil returning mode to the refrigerating mode; and switching the indoor unit from a heating mode to the refrigerating mode.

* * * * *